United States Patent [19]

Wolfe

[11] 4,372,512

[45] Feb. 8, 1983

[54] BAG SUPPORTING APPARATUS

[76] Inventor: W. Roger Wolfe, 3801 Northlake Creek Dr., Tucker, Ga. 30084

[21] Appl. No.: 263,359

[22] Filed: May 14, 1981

[51] Int. Cl.[3] ..... A63B 55/04

[52] U.S. Cl. ..... 248/97; 224/42.42

[58] Field of Search ..... 248/95, 97, 99, 100, 248/101; 53/390; 141/314, 391; 224/42.42; 232/43.2

[56] References Cited

U.S. PATENT DOCUMENTS

| | | | |
|---|---|---|---|
| 1,006,328 | 10/1911 | Widenhofer | 211/181 X |
| 2,020,014 | 11/1935 | Boenning | 108/160 |
| 3,193,240 | 7/1965 | Browett | 248/175 X |
| 3,687,408 | 8/1972 | Lake | 248/174 X |
| 3,737,129 | 6/1973 | Foster | 248/99 X |
| 4,029,244 | 6/1977 | Roberts | 224/42.42 X |
| 4,226,348 | 10/1980 | Dottor | 224/42.42 |

FOREIGN PATENT DOCUMENTS

| | | | |
|---|---|---|---|
| 1444044 | 5/1966 | France | 248/447 |
| 598057 | 4/1978 | Switzerland | 248/97 |

*Primary Examiner*—J. Franklin Foss
*Attorney, Agent, or Firm*—Jones & Askew

[57] ABSTRACT

Apparatus for supporting articles such as grocery bags or the like to prevent overturning or tipping. Two like bag supports are disclosed, each having a plurality of tines forming a base, and a bag upright support pivotably attached to the base. The bag upright support can be moved between a folded position and an upright position, and a latch automatically locks the apparatus in the upright position for supporting a bag or the like.

3 Claims, 3 Drawing Figures

BAG SUPPORTING APPARATUS

FIELD OF THE INVENTION

This invention relates in general to apparatus for supporting or stabilizing an upright article, and in particular relates to apparatus for supporting articles such as grocery bags or the like.

BACKGROUND OF THE INVENTION

Nearly everyone who shops for groceries has had one or more grocery bags overturn during the drive home from the store. The bags full of groceries are typically loaded into the trunk of an automobile, or into the open floor space near the back of a station wagon, and the bags receive little or no lateral support in these locations. Even mild cornering or stop-and-go driving can cause a grocery bag to overturn, especially where no canned goods or other relatively heavy articles are packed at the bottom of the bag. An overturned grocery bag is at best an inconvenience for the shopper, requiring him or her to retrieve and rebag the spilled contents which has typically spread itself all over the trunk or other area of the automobile. At worst, an overturned grocery bag will spill fragile or breakable articles, creating a wasteful and unsightly mess which must then be cleaned from the automobile.

Although various kinds of bag supporting structures are shown in the prior art, these structures are generally intended to hold the bag during a filling or loading operation. A support especially intended for stabilizing grocery bags should be relatively inexpensive to purchase, relatively sturdy and easy to use, and should fold or collapse into a relatively compact configuration occupying minimum trunk or other storage space when not actually in use.

SUMMARY OF INVENTION

Stated in general terms, the present invention provides a relatively lightweight, inexpensive and compact apparatus for supporting and stabilizing objects such as grocery bags or the like. The support apparatus of the present invention includes a pair of like support structures, each having a base readily fitting between the bottom of a grocery bag and an automobile trunk floor or other surface on which the bag rests. Each support apparatus also includes an upright support connected to the base and extending to engage one side of a grocery bag or other object to be stabilized. The base and upright support are pivotably attached to each other, and each support apparatus can be compactly stowed by folding together to form a substantially flat compact structure when not in use.

Stated somewhat more particularly, the base of each support apparatus includes a number of rod-like tines which are mutually spaced apart to provide stability for the support apparatus, and to accommodate the base tines of a like support apparatus disposed in mutually confronting relation. The space between the upright supports of each support apparatus defines an object receiving region of variable dimension, and one or more grocery bags or other objects to be stabilized may be disposed within this region resting on the overlapping tines of each like support apparatus.

Stated even more particularly the present support apparatus is preferably fabricated from elongated elements such as wire rod or the like, providing an inexpensive, lightweight, yet durable construction. The pivotable connection between the base and upright support includes a latch which automatically locks the upright support in place as that support is raised upwardly from folded position. This latch is readily released, when desired to return the support to its compact folded position.

Accordingly, it is an object of the present invention to provide improved support apparatus for supporting articles such as grocery bags or the like.

It is another object of the present invention to provide support apparatus for preventing grocery bags or the like from tipping or upsetting.

It is yet another object of the present invention to provide support apparatus for maintaining grocery bags or the like in a stabilized upright position, while being transported from place to place.

Other objects and advantages of the present invention will become more readily apparent from the following description of a preferred embodiment.

DESCRIPTION OF PREFERRED EMBODIMENT

Figure 1:
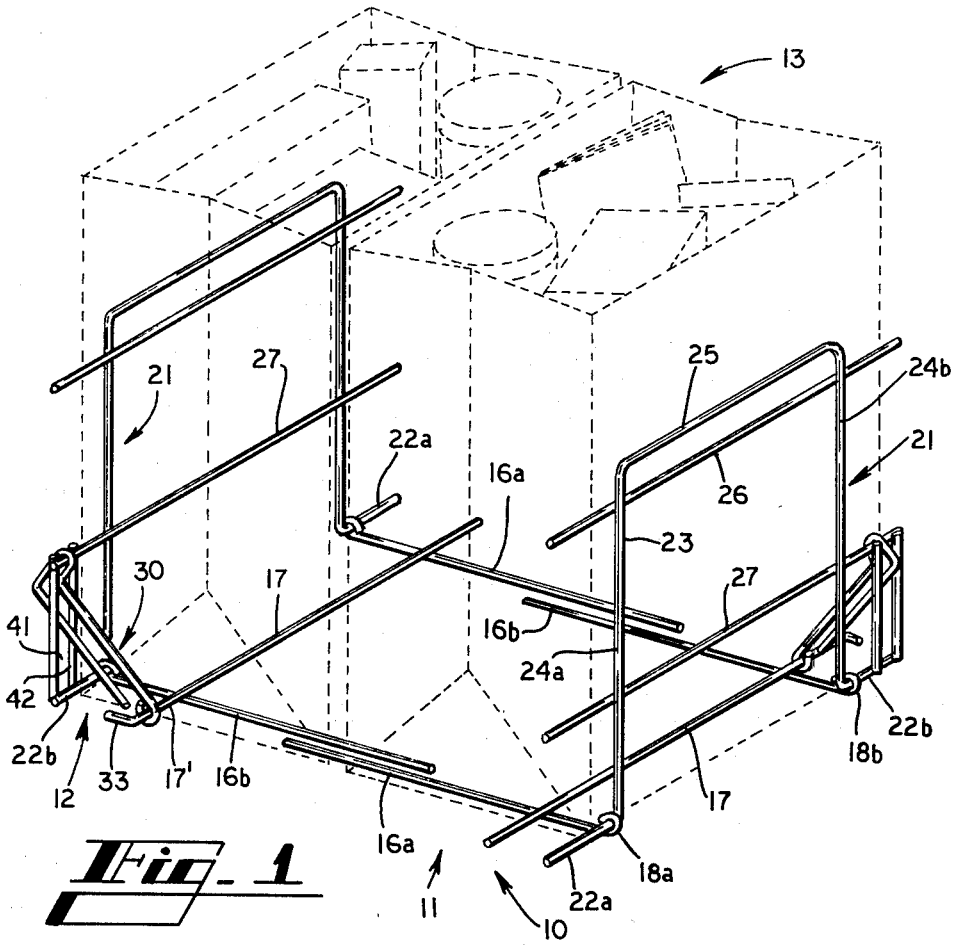
FIG. 1 is a pictorial view showing a like pair of bag supporting apparatus according to a preferred embodiment of the present invention, supporting a representative pair of grocery bags shown in broken line.

Turning first to FIG. 1, there is shown generally at 10 a pair of bag supports 11 and 12 according to the disclosed embodiment. Both the bag supports 11 and 12 are preferably identical in design and construction for understandable reasons of economy, and the two bag supports are shown facing each other in confronting relation to define an intervening space sufficient to receive and support one or more articles such as the loaded grocery bags indicated generally at 13. It will be appreciated that the bag supports 11 and 12 typically rest on a generally flat surface (not shown) such as the floor of an automobile trunk or the like.

Each bag support 11 and 12 includes a base including a pair of tines **16*a* and 16*b* mutually parallel and spaced apart sufficiently to provide stability for the bag support, while fitting beneath the bottom of one or more typical bags 13 resting on the tines. The tines 16*a* and 16*b***, along with other elements of the bag supports, may be fabricated from metallic rod such as 3/16 mild steel rod, for lightness and economy while providing the necessary strength and durability. Other materials will suggest themselves to those skilled in the art.

The tines **16*a* and 16*b* are bridged by a connecting rod 17 which lies on top of the tines near one end thereof, and is perpendicular to the tines. The ends of the connecting rod 17 extend outwardly a distance beyond each tine 16*a* and 16*b* for a purpose described below. The connecting rod 17 is preferably attached to the tines 16*a* and 16*b*** by welding at the crossing points between the connecting rod and the tines.

Each inner end **18*a* and 18*b* of the respective tines 16*a* and 16*b* is looped upwardly to form part of a hinge interconnection, and these hinge interconnections join together the tines with the bag upright support 21. A pair of rod extensions 22*a* and 22*b* pivotably extend through the looped ends 18***a* and 18*b* of the respective tines, and it can be seen that these rod extensions are the ends of a unitary inverted U-shaped support member 23 comprising the main body of the bag upright support 21.

The U-shaped support member 23 of each bag support 11 and 12 includes a pair of parallel support arms 24*a* and 24*b* extending from the hinge joints formed by corresponding rod extensions 22*a* and 22*b* passing through the looped ends 18*a* and 18*b* of the tines, and an end member 25 interconnecting the two support members and forming the base of the inverted U-shape of the support member 23. A pair of space-apart connecting rods 26 and 27 extend perpendicularly between the support arms 24*a* and 24*b* of the bag upright support 21, on the inside or bag-contacting surface thereof, to add structural rigidity to the bag support 21 and to increase the bag-contacting surface area of that support. The connecting rods 26 and 27 are welded to the support arms 24*a* and 24*b* at the crossing points.

Figure 3:
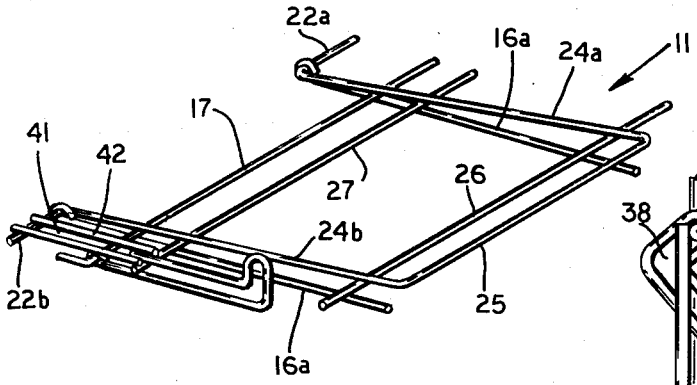
FIG. 3 is a pictorial view showing one of the supporting apparatus in folded configuration.

It should now be understood that the bag upright support 21 of each support 11 and 12 is pivotably attached to the tines 16*a* and 16*b*, through the hinge interconnection formed by the looped ends 18A and 18B and by the rod extensions 22*a* and 22*b*. This hinged interconnection of the support 21 with the tines allows the support member to assume either an upright back-supporting position shown in FIG. 1, or the folded position shown in FIG. 3 wherein the support 21 is pivoted forward to rest against the tines 16*a* and 16*b*. In this folded position, the connecting rods 26 and 27 of the upright support 21, and the connecting rod 17 of the base, permit the upright support to fold substantially flat against the tines 16A and 16B without becoming intertangled with each other. As is apparent from FIG. 3, the present apparatus folds substantially flat, so that each bag support 11 and 12 when folded occupies little usable space within an automobile trunk. The two bag supports thus can remain in the trunk or other location ready for use as needed.

Figure 2:
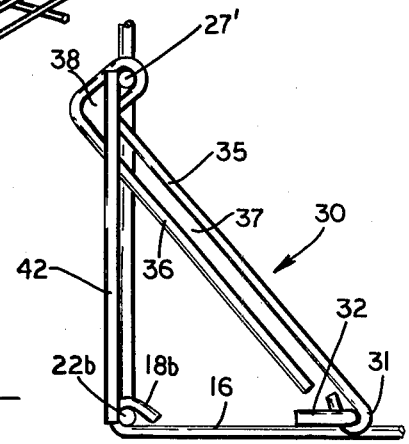
FIG. 2 is a detail elevation view showing the latch assembly used in each support apparatus shown in FIG. 1.

The upright support 21 is locked in the upright or bag-supporting position by a latch assembly best seen in FIG. 2. The latch assembly includes a latch engaging member 30 pivotably attached at one end 31 to an extension 17' of the connecting rod 17, and operating to engage a latch member formed as an extension 27' of the connecting rod 27 forming part of the pivotable upright support 21. The latch engaging member 30, in keeping with the mode of construction shown for the disclosed embodiment of the apparatus, is formed of a unitary length of wire rod having a lower end 32 curved to form a loop about the connecting rod extension 17'. The outermost end of the extension 17' is bent facing toward the rod extension 22*b* as shown at 33, FIG. 1, to retain the end 31 of the latch engaging member in place on the connecting rod extension.

The latch engaging member 30 includes two parallel lengths of rod 35 and 36 separated to define an elongated channel 37 sufficiently wide to accommodate sliding movement of the rod extension 27' without binding. Toward the end of latch engaging member 30 remote from the end 31 defining the pivotable hinge connection, the rods 35 and 36 undergo a right-angle bend to define a relatively short locking channel 38 substantially perpendicular to the channel 37, and extending upwardly therefrom as best seen in FIG. 2. The locking channel 38 also accommodates sliding movement of the rod extension 27'.

The rods 35 and 36 making up portions of the latch engaging member 30 are freely received within a slot 41 defined by a pair of rod segments collectively indicated at 42, best seen in FIG. 1, and forming part of the upright support 21. The slot 41 defines the desired position of the latch engaging member 30, and guides the movement of that member as the bag supporting apparatus pivots between its upright and folded positions.

The operation of the apparatus described above is now considered. With the bag support apparatus in the folded position shown in FIG. 3, both supports 11 and 12 can be conveniently stowed when not in use. Each support apparatus 11 and 12 is readily moved to the upright position simply by grasping any part of the upright support 21, and pivotably raising that upright support to its upright position as shown in FIG. 1. As the upright support 21 is raised, the rod extension 27 slides along the channel 37 in the latch engaging member 30. When the upright support 21 reaches upright position, the extension 27' enters the locking channel 38 permitting the latch engaging member 30 to pivot downwardly a short distance until the extension reaches the end of the locking channel; this fully-locked position is shown in detail in FIG. 2.

It is thus seen that each bag support 11 and 12 can be moved from folded position to upright position simply by raising the upright support 21 with one hand. The apparatus automatically latches in the upright position without requiring manual manipulation of any latching member or component. After bag supports 11 and 12 are each placed in the upright position, the two supports are then placed in spaced-apart confronting relation as shown in FIG. 1 with the tines 16*a* and 16*b* overlapping one another. The spacing between respective upright supports 21 is easily selected for the number of bags 13 to be supported. The upright supports 21 help stabilize the relatively unstable loaded grocery bags, and prevent these bags from overturning under lateral forces encountered during most normal driving conditions. Once a destination is reached and the bags 13 are removed, the supports 11 and 12 are easily returned to the folded configuration simply by manually raising the latch engaging member 30 to align the channel 37 with the extension 37'. The upright support 21 may then be pivotably returned to the folded position shown in FIG. 3, and it is seen that the latch engaging member 30 lies in substantially flat alignment with the tines and the upright support so that each support 10 and 11 occupies minimum volume when folded.

Although the foregoing description assumes that a pair of like supports 11 and 12 will be used in conjunction with each other, it should be understood that some article-supporting applications may require but a single support. Depending on the configuration of the automobile trunk or other environment, for example, a body panel or other solid upright object may conveniently support one side of a single bag, leaving the other side available for support by one of the bag supports 11 or 12.

It should also be understood that the foregoing relates only to a preferred embodiment of the present invention, and that numerous changes and modifications may be made therein without departing from the spirit and scope of the invention as defined in the following claims.

What is claimed is:

1. Support apparatus for stabilizing in an upright position at least one unstable object such as a grocery bag or the like, said apparatus comprising:

base means receivable beneath an object to be stabilized, said base means including a plural number of tines maintained in mutually spaced apart relationship in a common plane, to fit between the object being stabilized and a support surface;

upright support means pivotably connected to said base means, and selectably movable to occupy either an upright or a folded position relative to said base means;

latch means operatively associated with said object support means to maintain said object support means in the upright position relative to said base means, so as to contact and support an object received on said base means;

said latch means being selectably operative to allow the object support means to pivot to the folded position disposed alongside and substantially parallel to said tines of the base means;

said upright support means comprising a U-shaped member including a pair of spaced apart elongated support members individually pivotably connected to corresponding tines, and a bridging member extending between said elongated support members at a location spaced apart from said pivotable connection and rigidly interconnecting the elongated support members;

said latch means including a latch member connected to one of said elongated support members spaced apart from said pivotable connection, and a latch engaging member movably connected to the corresponding tine of said base means spaced apart from said pivotable connection;

said latch engaging member including a first channel extending from said movable connection and within which said latch member is slidably disposed, and a second channel joining said first channel at a substantial angle to selectably slidably receive said latch member;

said second channel being located above said first channel in position for alignment with said latch member when said elongated support members are moved to said upright position, so that the latch member enters said second channel and the latch engaging member automatically moves downwardly to latch the upright position when said latch member is moved along said first channel into alignment with said second channel; said latch engaging member being selectably operative to disengage the latching member when the latch engaging member is moved upwardly to return said latch member to said first channel; and guide means engaging said latch member to move said latch engaging member to position substantially in plane alignment with said tines and said upright support means when moved to said folded position, so that the entire apparatus is folded substantially flat for storage.

2. Apparatus as in claim 1, further comprising:

guide means associated with said upright support means and operative to support said latch engaging member in predetermined position when moved between folded position and upright position.

3. Apparatus as in claim 1 wherein:

said bridging member extends beyond one of said tines to provide a support for said latch engaging member; and said latch engaging member including means adjacent the end of said first channel remote from said second channel to pivotably engage said support, so that said latch engaging member is pivotably supported for said automatic movement to latch the upright position.

* * * * *